US008104913B2

(12) United States Patent
Wright

(10) Patent No.: US 8,104,913 B2
(45) Date of Patent: Jan. 31, 2012

(54) ILLUMINATED WRENCH SYSTEM

(76) Inventor: Clifford Wright, San Diego, CA (US)

( * ) Notice: Subject to any disclaimer, the term of this patent is extended or adjusted under 35 U.S.C. 154(b) by 78 days.

(21) Appl. No.: 12/426,633

(22) Filed: Apr. 20, 2009

(65) Prior Publication Data

US 2009/0290330 A1 Nov. 26, 2009

Related U.S. Application Data

(60) Provisional application No. 61/046,341, filed on Apr. 18, 2008.

(51) Int. Cl.
*F21V 33/00* (2006.01)

(52) U.S. Cl. ..... 362/119; 362/120; 362/109; 362/555

(58) Field of Classification Search ..... 362/109, 362/119, 120, 555
See application file for complete search history.

(56) References Cited

U.S. PATENT DOCUMENTS 7,114,824 B2 * 10/2006 Picone ..... 362/119

* cited by examiner

*Primary Examiner* — Anabel Ton
(74) *Attorney, Agent, or Firm* — Fred C. Hernandez; Mintz, Levin, Cohn, Ferris, Glovsky and Popeo, P.C.

(57) ABSTRACT

A tool system includes a first tool having a work area and a light source position inside the tool. The light source is adapted to illuminate the work area. A base has a first port, wherein the first tool can be mounted in the first port.

7 Claims, 11 Drawing Sheets

ILLUMINATED WRENCH SYSTEM

REFERENCE TO PRIORITY DOCUMENT

This application claims priority of U.S. Provisional Patent Application Ser. No. 61/046,341, filed Apr. 18, 2008. Priority of the aforementioned filing date is hereby claimed and the disclosure of the Provisional Patent Application is hereby incorporated by reference in its entirety.

BACKGROUND

The present disclosure relates to a tool system. More particularly, the present disclosure relates to a system of tools having an integrated lighting and charging mechanism.

A user of a tool, such as a wrench, must often work in an work area where there is little or no light available. In order to adequately view the work area, the user must secure a separate source of light, such as a flashlight or a lamp, to illuminate the work area. This can be a cumbersome process as the user is required to grasp the separate light source with one hand while using the tool with the other hand. It can also be unsafe since the user can be required to divide his or her attention between use of the tool and use of the light source.

Moreover, the user may not have a light source handy, which may require the user to leave the work area to look for a source of light. This can be a time consuming and frustrating process particularly for a user that wants to focus on the job at hand, which is using the tool.

SUMMARY

In view of the foregoing, there is a need for a tool or a system of tools that have a readily available source of light for illuminating a work area of the tool. In one aspect, there is disclosed a tool system, comprising: a first tool having a work area; a light source position inside the tool, wherein the light source is adapted to illuminate the work area; and a base having a first port, wherein the first tool can be mounted in the first port.

Other features and advantages will be apparent from the following description of various embodiments, which illustrate, by way of example, the principles of the disclosed devices and methods.

DETAILED DESCRIPTION

Disclosed is a tool system comprised a tool, such as a wrench, that includes an internal light source that can be illuminated to focus a beam of light towards a work area for the tool, such as toward the head or heads of the wrench. In an embodiment, the system includes a base that removably receives a set of tools, such as a set of wrenches. The base can be used to store the tools during non-use of the tools. Each of the tools includes an internal light source that can be illuminated to focus a beam of light towards a work area for the tool, such as toward the head or heads of the wrench. The focuses light advantageously illuminates the work area while the tool is in use so that the user of the tool does not need to grasp or otherwise obtain a separate light source for illumination. In an embodiment, each of the tools includes an internal battery that is charged by coupling the tool to the base. In this manner, the tools can be stored on the base during non-use so that the batteries remain charged and ready for use when a need for the tools arise.

Figure 1A:
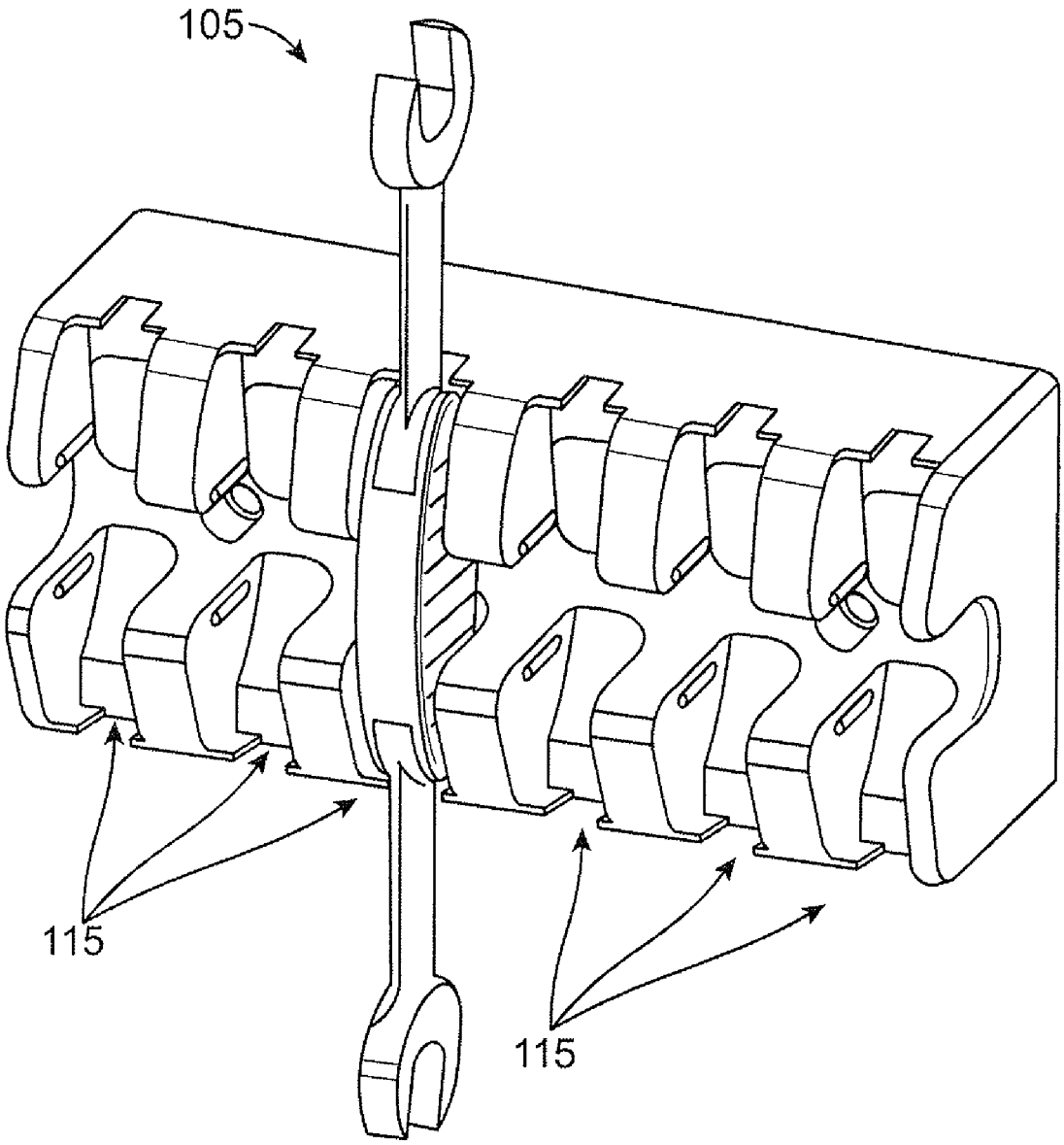
FIG. 1A is a perspective view of a tool system having at least one tool, such as a wrench, that removably mounts onto a base.

FIG. 1A is a perspective view of a tool system comprised of at least one tool, such as a wrench 105, that removably mounts onto a base 110. The base 110 includes a plurality of ports 115 wherein each port 115 is configured to removably receive a wrench 105. The quantity of ports can vary such as based on the quantity of tools in the set. FIG. 1A shows only a single wrench 105 of the tool system for clarity of illustration. It should be appreciated that the actual tool system can include a plurality of wrenches 105 that are each configured to removably dock onto a respective port 115 of the base 110. For example, the system can include several wrenches of different sizes such that the base 110 can receive an entire set of wrenches.

The tool is described herein for purposes of example as being a wrench. However, it should be appreciated that the tool can be any of a variety of tool types and that the tool is not limited to being a wrench. For example, the tool can be a screwdriver or any other tool that is adapted for use in a work space. The base 110 is adapted to be portable or it can be adapted to be mounted on a work surface or on a wall.

Figure 1B:
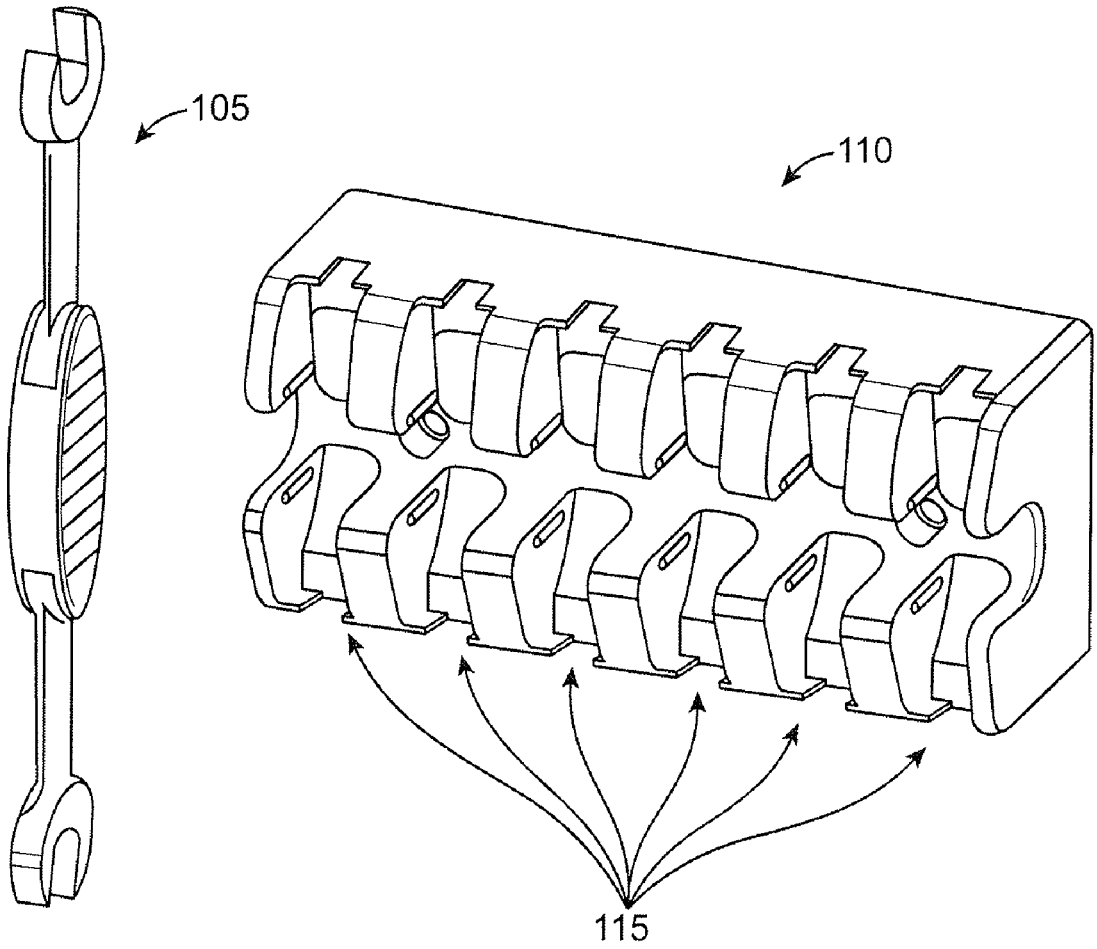
FIG. 1B shows the system with the wrench removed from the base.

FIG. 1B shows the system with the wrench 105 removed from the base 110. A user can mount the wrench 105 to the base 110 during non-use of the wrench. In this manner, the base 110 conveniently serves as a means of storage for the wrench 105. Moreover, the base 110 serves as a charger for charging an internal battery within the wrench 105 that powers an internal light source, as described more fully below. Each of the ports 115 has one or more leads that interface with electronic components within the wrench for charging the battery within the wrench. The base 110 includes means for coupling the base to a source of power such as electrical power. In this regard, the base 110 can couple to a separate battery or it can couple to an AC electrical source in a well known manner.

Figure 2:
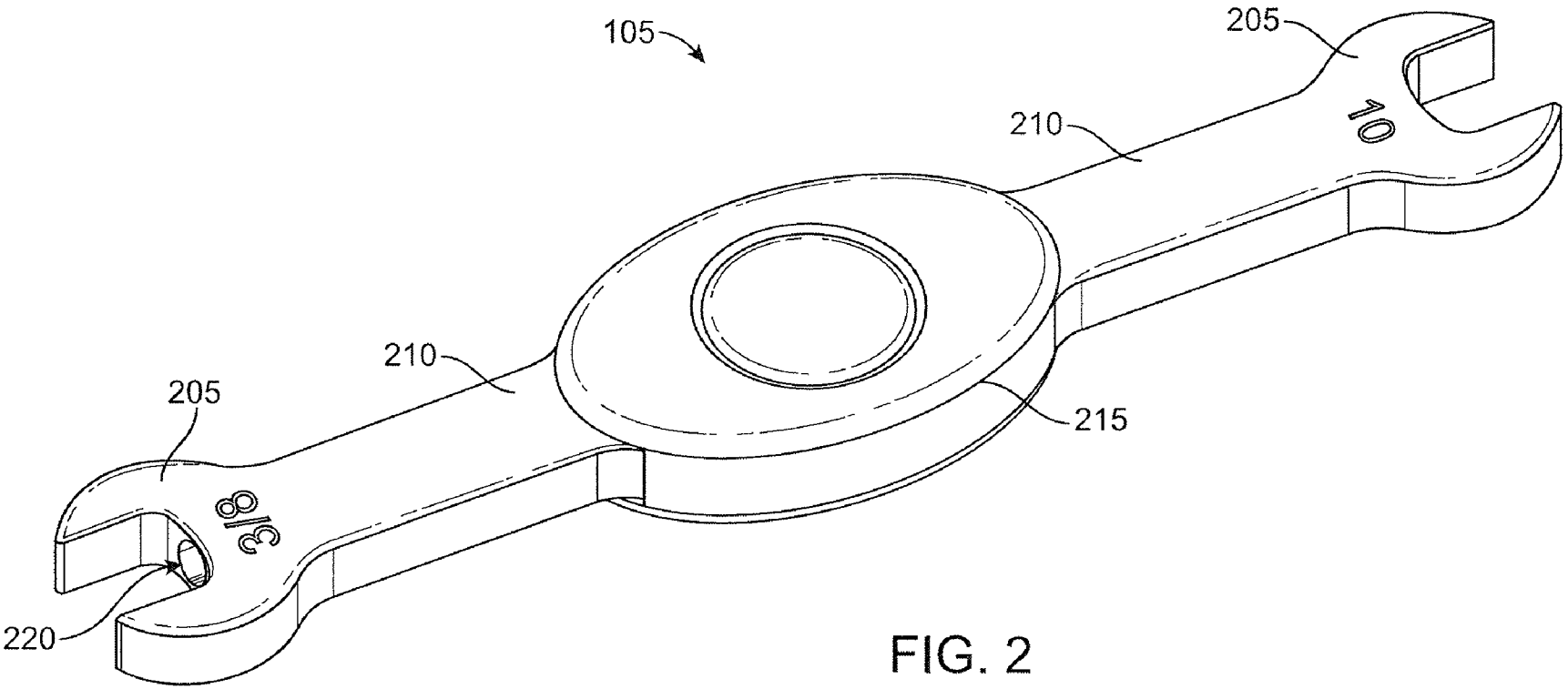
FIG. 2 shows a perspective view of the wrench in an assembled state.
Figure 3:
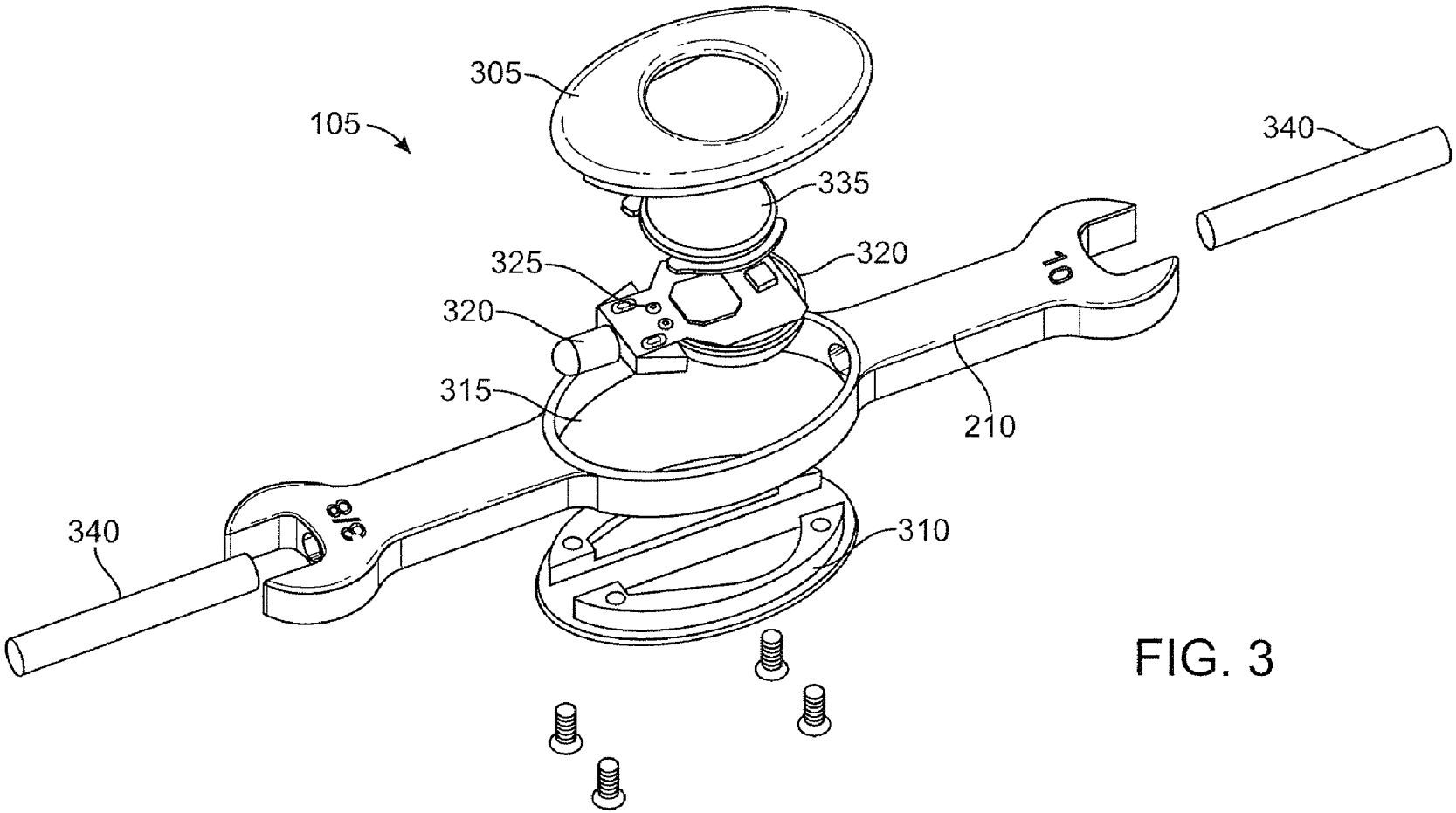
FIG. 3 shows the wrench in an exploded state.

FIG. 2 shows a perspective view of the wrench 105 in an assembled state while FIG. 3 shows the wrench in an exploded state. The wrench includes at least one work region comprised of a head 205 that is configured to couple to a bolt or nut for applying torque thereto. The work region is the region of a tool where the tool performs work or couples to another tool. In this regard, the head 205 is an open-ended head with a U-shaped opening that grips two opposite faces of the bolt or nut. It should be appreciated that the wrench is not limited to an open ended head, but can include various other types of heads that couples to a bolt, nut, or anything else that requires the application of torque. The wrench 105 is shown as a double-ended wrench such that there is a head 205 on each of opposite ends, although the wrench does not need to be double ended. The heads or any other region of the wrench can include one or more labels such as to provide an indication of the size of the tool.

The work area of the tool can vary based on the type of tool. For example, in the case of a wrench the work area can be the head of the wrench that is adapted to interface with a nut or bolt. In the case of a screw driver, the work area can be the head of the screw driver that interfaces with a screw. The screw driver can have any type of head such as a Phillips head, a flat head, or an Allen-type head. As mentioned, the type of tool can vary as can the type and location of the work area of the tool.

The wrench 105 includes an elongated handle 210 having opposite ends on which are positioned the heads 205. A central housing 215 is positioned on the handle such as at or in the region of the midpoint location of the handle. The housing 215 is sized and shaped to removably mount within one of the ports 115 of the base 110 (FIG. 1). In this regard, the housing 215 can have a rounded or enlarged shape relative to the handle 210. Such a shape can facilitate docking into a port 115 and can also facilitate grasping of the handle. It should be appreciated that the shape of the housing 215 can vary and that the housing can be integral with the handle or monolithic with the handle. The housing 215 contains an internal cavity that houses electronic components and a light source for providing light to the heads 205 of the wrench 105, as described in detail below.

Each of the heads 205 has an opening 220 that communicates with the a light source inside the housing 215 via an internal light shaft. The housing contains a light source, which provides light to the heads 205 of the wrench 105 such as a focused beam of light. This is described in more detail with reference to FIG. 3, which shows an exploded view of the wrench 105. The housing 215 is formed of an upper cover 305 and a lower cover 310 that removably couple to a central seat or opening 315 in the handle 210 to collectively enclose the internal cavity of the cover. Attachment devices, such as screws 318, can be used to secure the covers 305, 310 to one another and to the handle 210. The size, shape, and structural configuration of the housing 215 may vary, as may the internal components of the housing 215.

As mentioned, the housing 215 contains a light source 320, such as a light emitting diode (LED) or any other type of light source. The light source 320 is coupled to electronic components such as a printed circuit (PC) board 325 and a battery 330 for providing power to the light source 320. The battery 330 is automatically charged when the wrench 105 is mounted onto one of the ports in the base 110. The PC board 325 is coupled to a button 335 that can be actuated by a user to toggle the light source 320 between an "on" state in which the light source is illuminated and an "off" state in which the light source is not illuminated. The button 335 is sized and shaped to be positioned within an opening in the upper cover 305. It should be appreciated that means other than a button can be employed to turn the light source on and off.

With further reference to FIG. 3, a pair of elongated, tubular focusing means or lenses 340 are sized and shaped to be positioned within a pair of internal shafts. The lenses can be any type of device that transmits and/or focuses light, such as an optical fiber. In an embodiment, the lens 340 is made of plastic and is press fit into a shaft or opening that extends through the handle. The internal shafts run the length of the handle 210 from the housing 215 to the heads 205. When the lenses 340 are mounted within the internal shafts, the lenses provide a means of focusing and directing light from the light source 320 to each of the heads 205 of the wrench. In this manner, a focused beam of light can be directed from the illuminated light source 320 to one or more of the heads 205. It should be appreciated that the wrench can include any quantity of light sources within the housing 215 and that the type of light source can vary. An LED is particularly useful since it can provide a narrow spectrum beam of light of various colors.

In an embodiment, the lens 340 is a fiber optic cable or a bundle of fiber optic cables that carries light from a light source to the work area of the tool.

Figure 4:
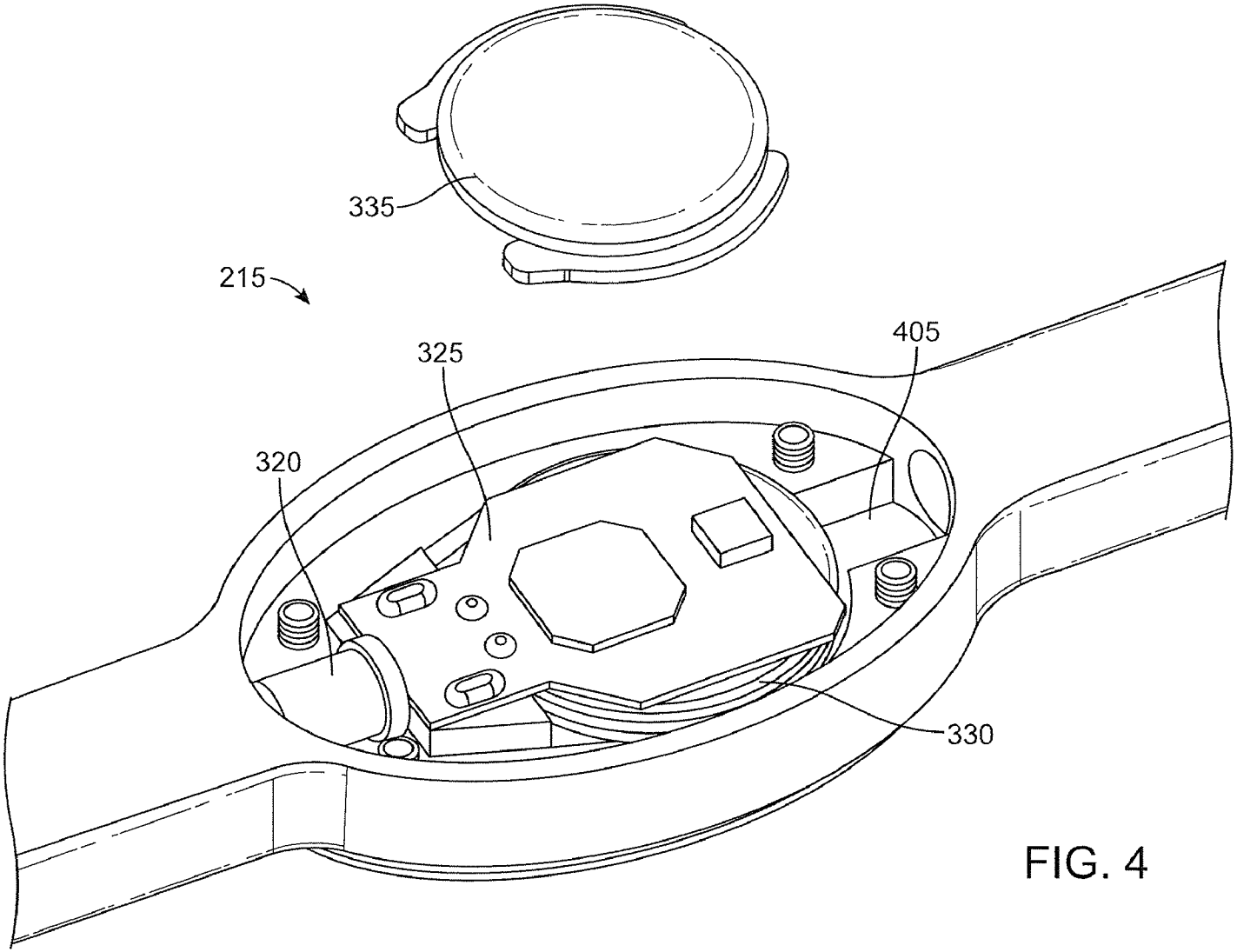
FIG. 4 shows an enlarged view of a housing of the wrench with an upper cover removed.

FIG. 4 shows an enlarged view of the housing 215 with the upper cover 305 removed and the button 335 lifted upward relative to the electronic components to reveal the internal cavity within the housing 215. The PC board 325 is sized to fit snug within the housing 215. The light source 320 mounts within the housing such that it is positioned immediately adjacent the internal shaft that houses the lens 340 within the handle. In this manner, the light source 320 is positioned so that it can direct light toward the lens 340 where the light can be focused or otherwise transmitted toward the respective wrench head.

The wrench can include more than one light sources such as a light source dedicated to each one of the wrench heads 205. In this regard, the housing contains a seat 405 for each light source 320 wherein the seat 405 positions the light source 320 adjacent a respective internal shaft and lens. In the actual device, a light source 320 would be positioned in the seat 405.

In use, the wrench 105 is removed from the base 110. As mentioned, the base 110 can include a set of wrenches comprised of a plurality of wrenches of various sizes. The user can select a wrench of desired size and then remove the wrench from the base 110 for use. As discussed, the battery should be in a charged state when the wrench is removed from the base since the battery automatically charges while the wrench is mounted on the base. The user couples one of the wrench heads 205 to a nut, bolt, or other work space device to which torque is to be applied.

Figure 5:
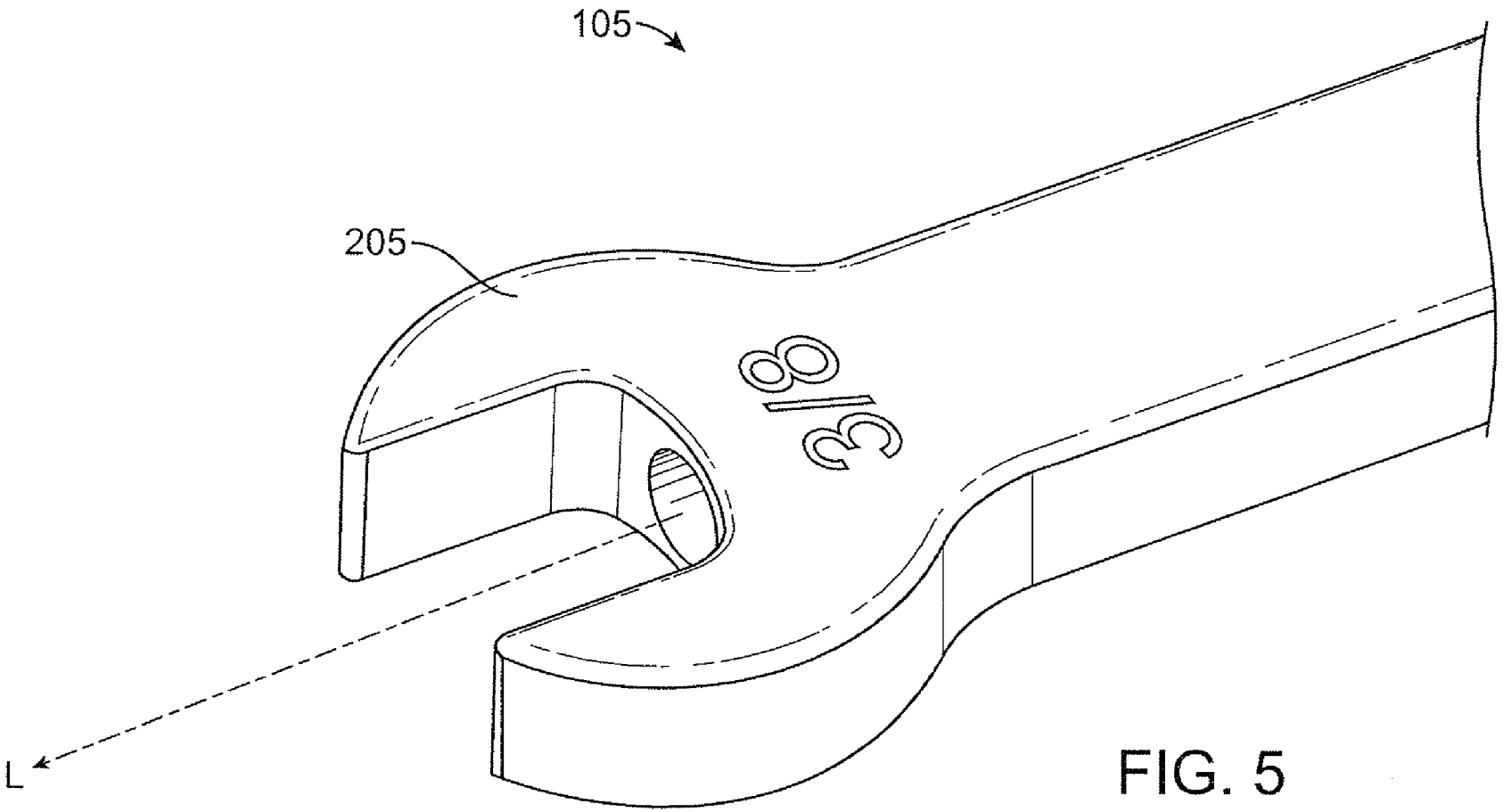
FIG. 5 shows the wrench with an internal light source in an "on" state such that a beam of light is focused on or near the vicinity of the wrench head.

If the user desires to illuminate the work space, the user simply presses the button 335 to power the internal light source 320. This causes a focused beam of light to travel from the light source, through the lens in the handle, and out of the opening in the wrench head. FIG. 5 shows the wrench 105 with the light source in an illuminated or "on" state such that a beam of light (represented by arrow L in FIG. 5) passes in the vicinity of the wrench head 205. In this manner, the work area of the tool is illuminated.

Figure 6:
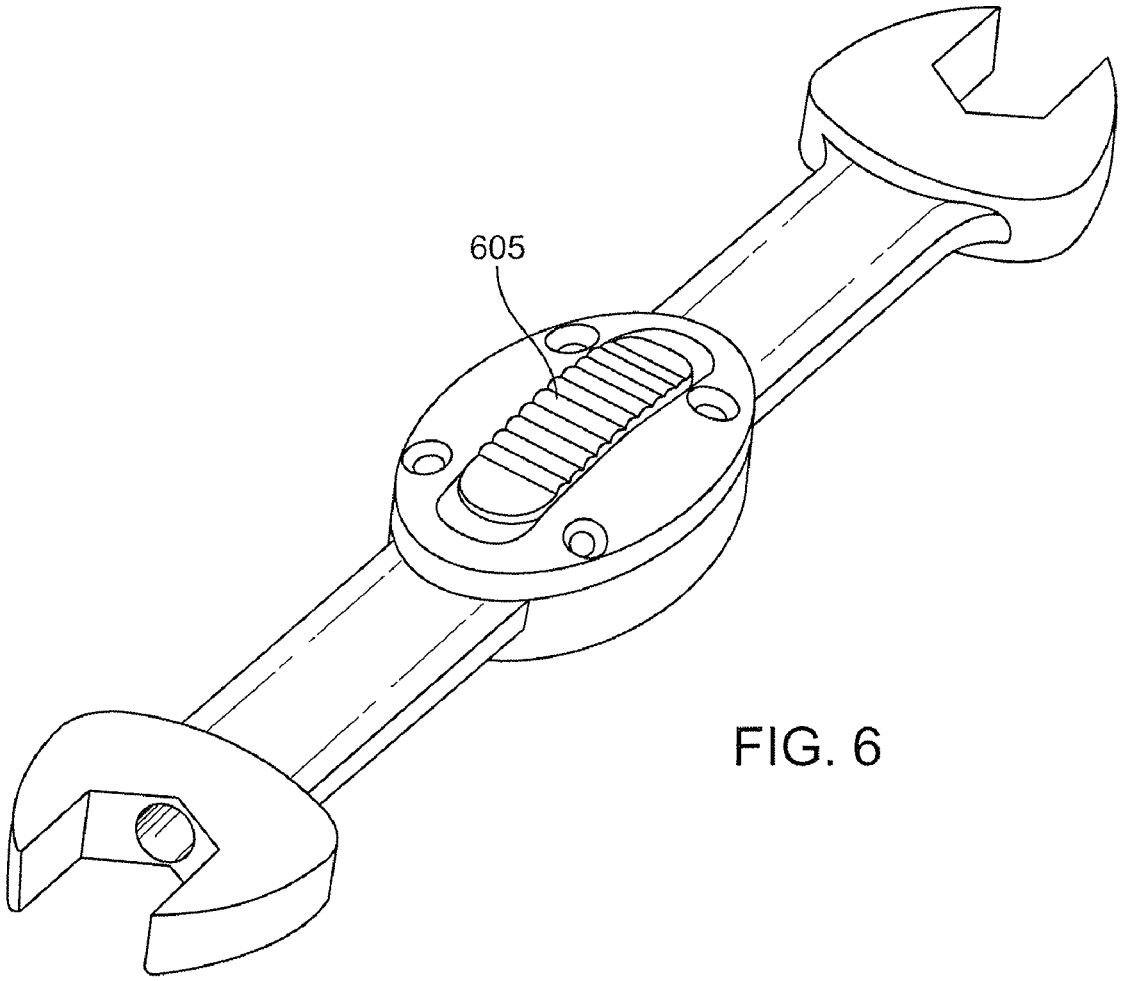
FIG. 6 shows an embodiment of the wrench that includes a slidable switch for toggling the light source between on and off states.

It should be appreciated that the tool system is not limited to the specific embodiments described herein. Some additional embodiments are now described. FIG. 6 shows an embodiment of the wrench that includes a slidable switch 605 for toggling the light source between the on and off states. It should be appreciated that any type of actuation system can be used for turning the light source on and off and that various types of movements or actuation mechanisms can be used for this purpose.

Figure 7:
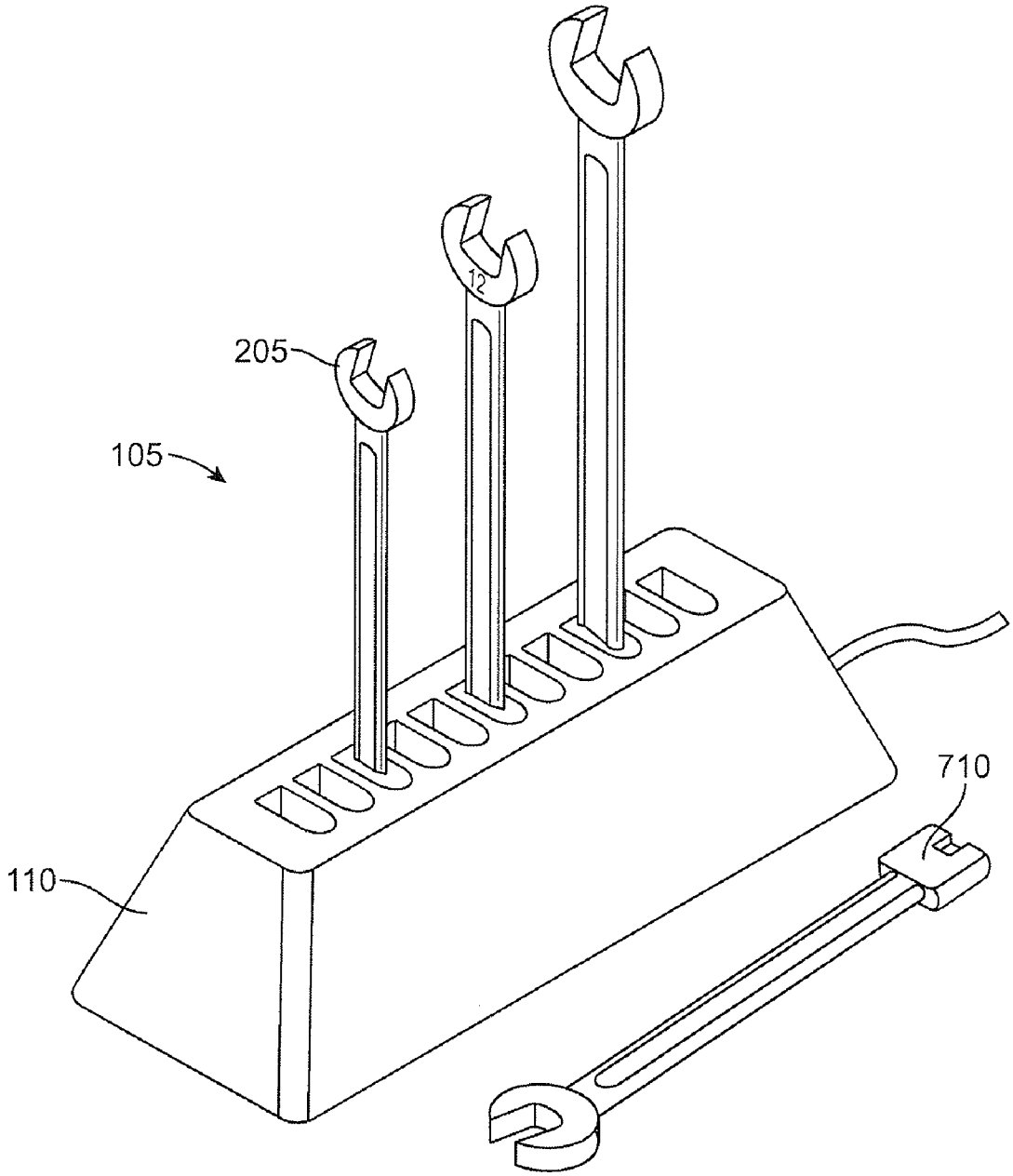
FIG. 7 shows another embodiment of the tool system.

FIG. 7 shows another embodiment of the tool system. In this embodiment, each of the wrenches 105 is a single ended wrench with a single head 205 comprised of an open-ended head with a U-shaped opening that grips two opposite faces of the bolt or nut. The end opposite the head 205 is an interface 710 that couples to the base 110 for securing the wrench to the base 110 and charging the internal battery. The ports are in the form of pockets that receive the interfaces 710 of the wrenches. Various mechanisms and configurations can be used to couple the wrench to the base. Moreover, the tool does not have to be a wrench but can be any type of tool that would benefit from a focused beam of light on the tool's work area.

Figure 8:
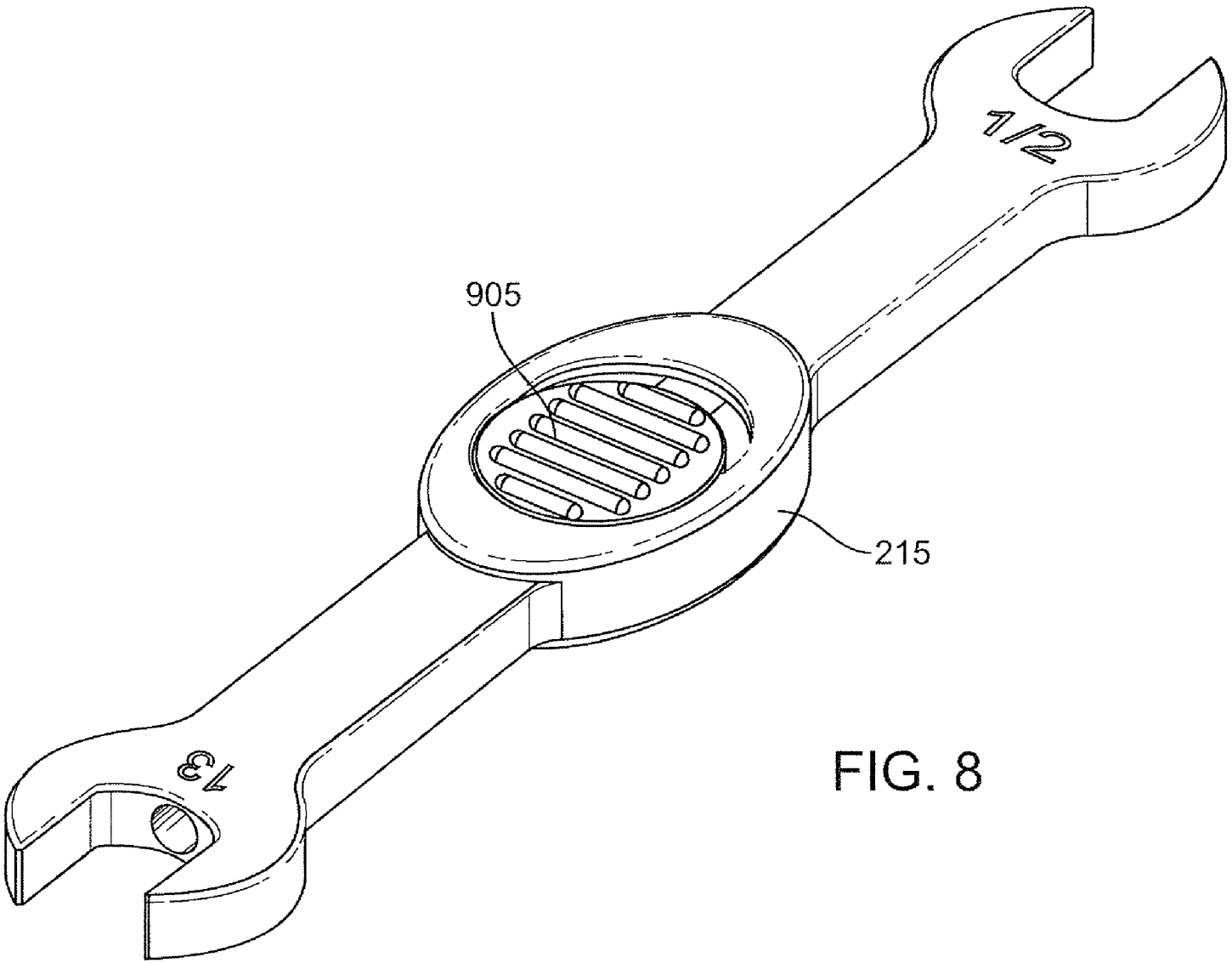
FIG. 8 shows an assembled view of another embodiment of the tool system.
Figure 9:
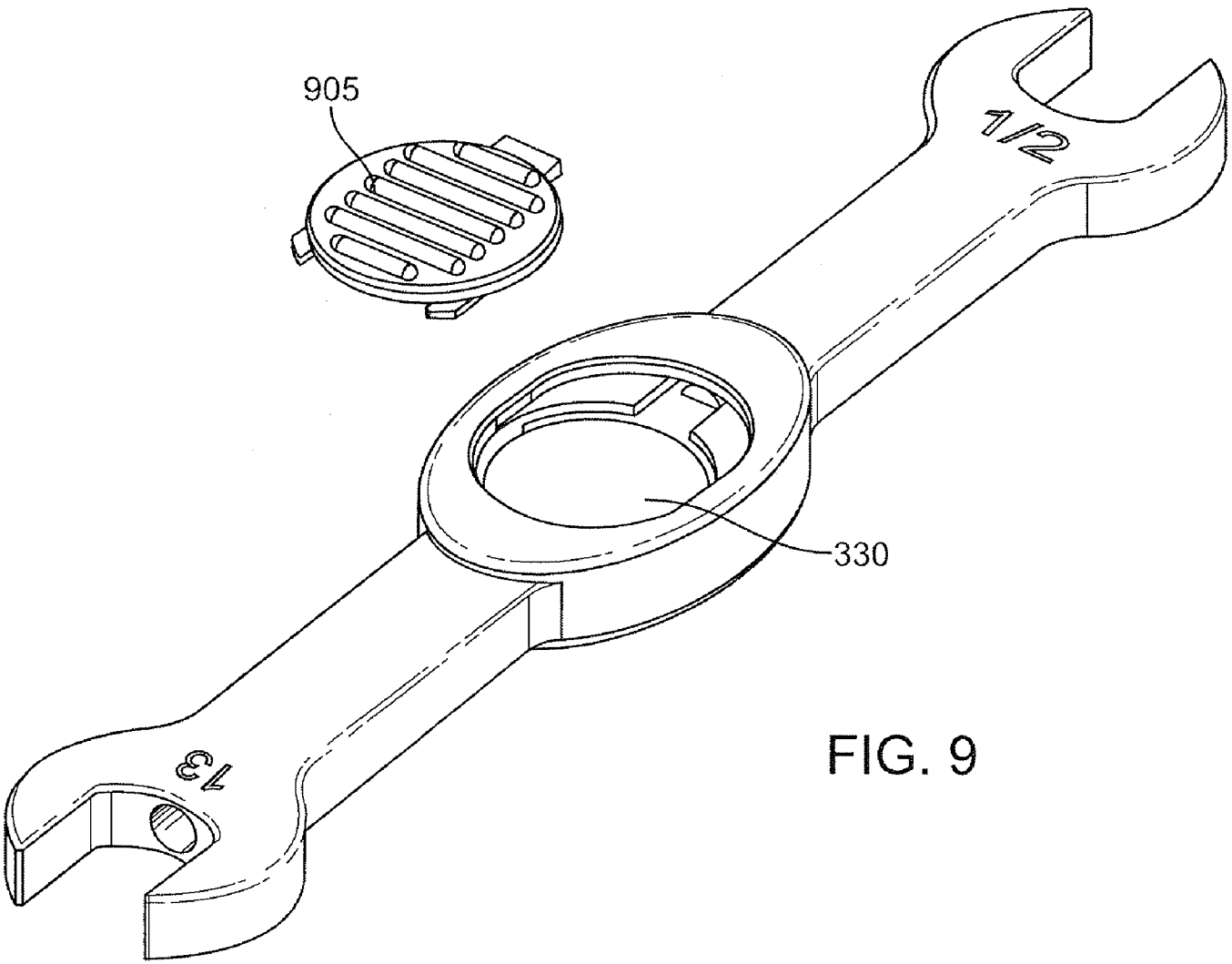
FIG. 9 shows view of the embodiment of FIG. 8 with a plastic cover removed from the central section.

FIG. 8 shows an assembled view of another embodiment of the tool system. FIG. 9 shows view of the embodiment of FIG. 8 with a plastic cover removed from the central section. In this embodiment, the central housing 215 of the wrench 105 includes a cover 805 that snaps onto or otherwise removably mounts onto the wrench. As shown in FIG. 9, the cover 805 can be removed from the central housing 215. The removal can occur in a variety of manners. For example, the cover 805 can transition (such as in a sliding fashion) to a locked state wherein the cover 805 is secured to the central section, and an unlocked state wherein the cover 805 is removed or partially removed from the central section. In the unlocked state, the cover 805 is in a position such that a battery compartment in the central section is exposed to permit removal and installation of the battery 330.

Figure 10:
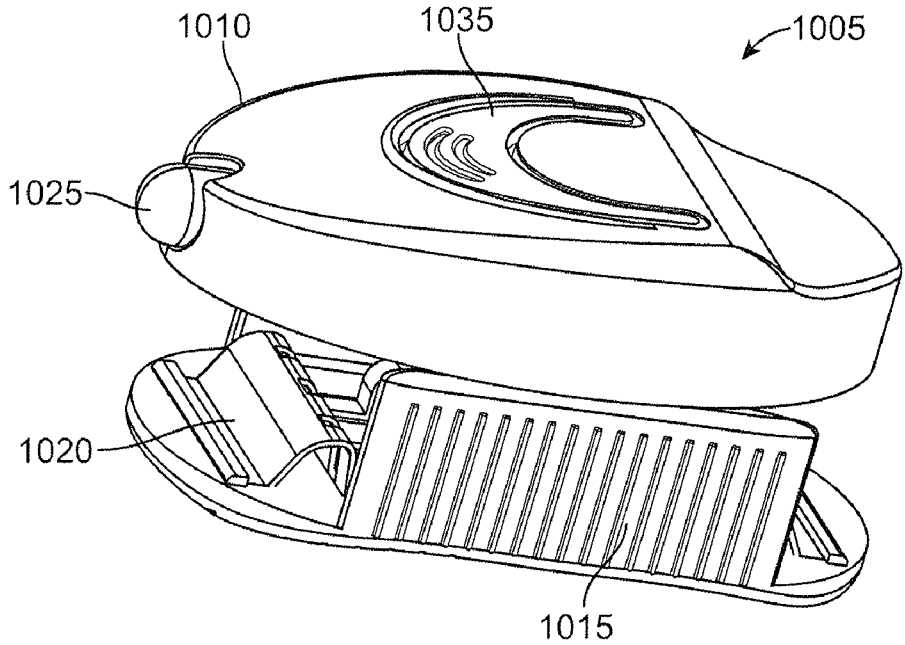
FIGS. 10 and 11 show an embodiment of a removably mounted light assembly for a tool.
Figure 11:
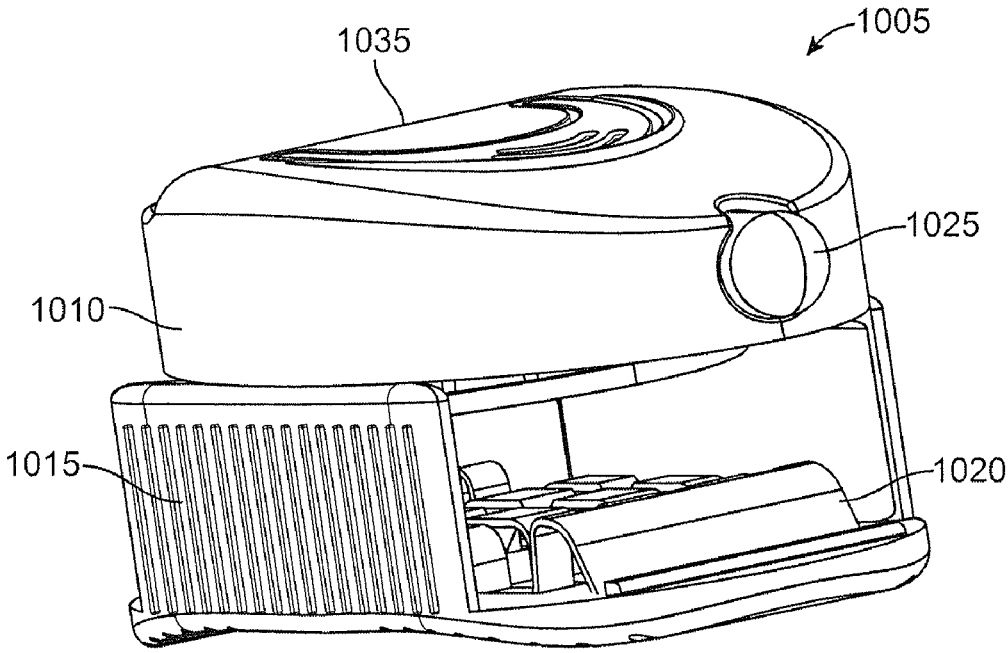

In another embodiment, the housing 215 is not mounted in an opening on the handle of the wrench. Rather, the housing is movably and/or removably mounted on a standard wrench or on some portion of the tool. FIGS. 10 and 11 show an embodiment of a light housing 1005 that is adapted to be removably and/or movably mounted on a handle portion of a wrench. In this regard, the wrench may be a standard wrench having a head and an elongate handle that extends from the head. For example, the wrench may be configured as the wrench shown in FIG. 2 but without the central housing 215 in the middle of the handle 210.

The housing 1005 has an upper component 1010 and a lower component 1015 with a passageway 1020 defined therebetween. The passageway is size and shaped to receive a portion of tool, such as to slidably receive the handle of a wrench. One or more members 1020 may be positioned inside the passageway 1020 to abut the handle of the wrench such as to provide an interfering press fit and maintain the housing in a fixed position on the handle. The members 1020 may be flexible or deformable such that pressure may be exerted thereon to temporarily deform the members and permit repositioning of the housing 1005 on the handle.

The upper component 1015 of the housing 1005 contains a light source and/or electronic components that are adapted to transmit light, such as via a lens 1025. In this regard, the housing 1005 may contain one or more of the components contained in the housing 215 described above and may also include any other external components that permit the housing to generate and transmit light. The housing 100 5 includes a button 1035 or other actuation element that can be actuated to turn on or turn off the light of the housing 1015. The upper component 1015 may optionally be rotatably mounted on the lower component to permit variation in the direction of illumination of the light source.

The upper component 1015 and the lower component 1020 can be detached from one another and mounted over the handle of a standard wrench with the handle positioned in the passageway 1020. This permits the housing 1005 to be slidably positioned to a desired location on the handle. In an embodiment, the light source can be illuminated in various manners, such as high, low, flashing, etc. The housing 1015 can include a rechargeable battery.

Although embodiments of various methods and devices are described herein in detail with reference to certain versions, it should be appreciated that other versions, embodiments, methods of use, and combinations thereof are also possible. Therefore the spirit and scope of the disclosed devices and methods should not be limited to the description of the embodiments contained herein.

The invention claimed is:

1. A tool system, comprising:

a first tool having a work area, the first tool comprising a wrench having a wrench head;

a light source positioned inside the tool and coupled to the wrench head, wherein the light source is adapted to illuminate the work area and wherein the light source and the wrench head are simultaneously part of the first tool;

an elongated lens that extends from a location of the light source to the wrench head, the elongated lens configured to focus light from the light source toward the wrench head;

a base having a first port, wherein the first tool can be mounted in the first port.

2. A system as in claim 1, further comprising a second tool and a second port in the base, wherein the second tool can be mounted in the second port.

3. A system as in claim 1, further comprising a battery mounted in the first tool, wherein the base is adapted to charge the battery when the first tool is mounted in the first port.

4. A system as in claim 1, further comprising a switch coupled to the first tool, wherein the switch can be used to turn the light source on and off.

5. A system as in claim 1, wherein the work area is an open ended head of the wrench, the open ended head adapted to be coupled to a nut or bolt.

6. A system as in claim 1, wherein the light source is a light emitting diode.

7. A system as in claim 1, wherein the first tool has a handle and wherein the light source is mounted inside the handle.

* * * * *